United States Patent [19]

Haga et al.

[11] 4,106,892

[45] Aug. 15, 1978

[54] APPARATUS FOR HEAT TREATMENT USING DOWNWARDLY SWIRLING HOT GAS FLOW

[75] Inventors: Toshikatsu Haga; Saburo Hori, both of Iwaki, Japan

[73] Assignee: Kureha Kagaku Kogyo Kabushiki Kaisha, Nihonbashi, Japan

[21] Appl. No.: 746,574

[22] Filed: Dec. 1, 1976

[30] Foreign Application Priority Data

| | | | |
|---|---|---|---|
| Dec. 23, 1975 | [JP] | Japan | 50-173227[U] |
| Dec. 4, 1975 | [JP] | Japan | 50-143312 |
| Mar. 10, 1976 | [JP] | Japan | 51-25013 |

[51] Int. Cl.[2] ..... F27B 15/00

[52] U.S. Cl. ..... 432/58; 34/57 E

[58] Field of Search ..... 432/14, 15, 58; 34/57 E

[56] References Cited

U.S. PATENT DOCUMENTS

| | | | |
|---|---|---|---|
| 3,494,047 | 2/1970 | Geiger et al. | 34/57 E |
| 3,600,817 | 8/1971 | Klein | 34/57 E |
| 3,740,865 | 6/1973 | Laguilharre | 34/57 E |
| 4,030,876 | 6/1977 | Akae et al. | 432/14 |

*Primary Examiner*—John J. Camby

*Attorney, Agent, or Firm*—Sughrue, Rothwell, Mion, Zinn and Macpeak

[57] ABSTRACT

Hot gas is introduced into a heat treatment furnace 10 through a plurality of nozzles 11 on the furnace wall to form a conical, downwardly swirling gas flow which is convergent at the top and divergent at the bottom. Such a gas flow pattern both heats the bed below, and acts to contain and oxidize any particles blown or splashed up out of the bed. Exhaust gas is discharged up through the conical apex of the swirling flow. The downward angle $\alpha$ that each nozzle axis forms with the vertical furnace wall is defined by $0<\alpha\leqq 30°$, and the inclination angle $\beta$ of each nozzle axis with a horizontal line tangent to the furnace circumference is defined by $45°\leqq\beta\leqq 85°$.

7 Claims, 8 Drawing Figures

APPARATUS FOR HEAT TREATMENT USING DOWNWARDLY SWIRLING HOT GAS FLOW

BACKGROUND OF THE INVENTION

This invention relates to a method and apparatus for the heat treatment of solid and fluid materials in a furnace with, for example, hot air.

Heretofore, an apparatus in which heated fluid is introduced, either from above or below, into a fluid, movable, or stationary bed of material to be treated has been used as a combustion furnace, a cracking furnace, a burning furnace, a carbon activating furnace, a roasting furnace, and a recovery furnace.

A difficulty with such apparatuses is that light particles splash out of the bed. The light particles are those initially contained in the bed material to be treated, and those created by the physical and chemical interaction between the bed material and the heated fluid. It is very difficult to retain these light particles in the bed and to control their interaction in the bed. Accordingly, heat treatment furnaces and devices for separating and recovering solid matter from the gas have been separately provided, which is disadvantageous in terms of installation cost and size.

As an environmental problem, and for minimizing air pollution, there is a strong demand for the heat-treatment of minute solid particles, such as soot and waste materials generated in industrial plants and treatment facilities, and sludge which includes such particles. For example, a great quantity of incomplete combustion particles are entrained in the gas discharged through the funnel of a boiler or an incinerator. This is one of the basic causes of air pollution. Also, large quantities of carbon dust are recovered from the collecting sections of electric generator plant boilers, which include 50 – 98% carbon containing ash such as ammonium sulfate, metal, silica, and alumina. The heat treatment of such carbon dust is necessary. All of the metal machining industries employ some type of metal polishing process, in which an abrasive and metal powders become mixed in an oil and water sludge. It is necessary to heat-treat such sludge to recover the metal and the abrasive powder, in order to prevent air pollution thereby.

There are many kinds of industrial sludge, such as metal sludge, sludge created in the food industry, paper sludge, and sludge obtained by polishing quartz.

Asbestos is employed in a number of industrial fields, such as for gaskets, packings, electrolytic diaphragms, brakes, heat insulators and heat resisting materials. In the processes of preparing the raw material, and in molding, cutting and polishing it, a great quantity of waste is created.

It is also necessary to recycle industrial molding sand, which includes about 1% by weight of phenol resin as an adhesive. In addition, chemicals such as ammonium sulfate, hydrogensulfate alkali metal salt, dithionic acid, imidodisulfonate, etc. produced in desulfurization and denitrization processes by the boilers and furnaces must be thermally cracked.

Heretofore, most asbestos containing waste materials have been abandoned. More recently, however, the discarding of these waste materials has been prohibited since it is now known that asbestos is a major cause of lung cancer.

Thus, there is a great demand for a compact and efficient heat treating apparatus suitable for treating minute solid particles.

Several methods for separating and collecting soot from gas and burning it again have been proposed in the art. Since, soot has a low specific gravity, however, it is difficult to centrifugally separate and collect it. It is also difficult to collect soot with an electrical precipitator, because its electrical resistance is very low. Thus, while soot is readily charged, upon collection its polarity becomes the same as that of the electrode, as a result of which the soot is released and returned into the atmosphere.

In addition, the prior art methods of burning soot suffer from the disadvantage that the apparatuses required are unduly large, and it is difficult to achieve complete combustion in them.

As a result, soots and sludges such as metallic sludge, food sludge, paper sludge, and quartz polishing sludge, and minute solid particles such as molding sand and asbestos, have not been recycled or utilized again in the past, but have merely been discarded. A method of utilizing such waste materials has not yet been proposed.

SUMMARY OF THE INVENTION

Accordingly, an object of this invention is to provide a method and apparatus for heat treatment in which the quantity of minute particles exhausted from a heat treatment furnace is greatly reduced, and wherein the apparatus is compact and efficient.

Briefly, and in accordance with the invention, gas is introduced through a plurality of nozzles on the wall of a heat treatment furnace to form a downwardly swirling flow which is convergent at the top and divergent at the bottom. Such downwardly swirling flow heat-treats the bed of material below, and also any particles splashing or blown out of the bed, the exhaust gas being discharged through the top part or conical apex of the swirling flow. The downward angle $\alpha$ of ech gas inlet nozzle with the wall of the furnace is defined by $0 < \alpha \leqq 30°$, and the inclination angle $\beta$ that each nozzle axis forms with a line tangent to the furnace circumference, in a horizontal sectional plane, is defined by $45° \leqq \alpha \leqq 85°$.

DETAILED DESCRIPTION OF THE PREFERRED EMBODIMENTS

Figure 1:
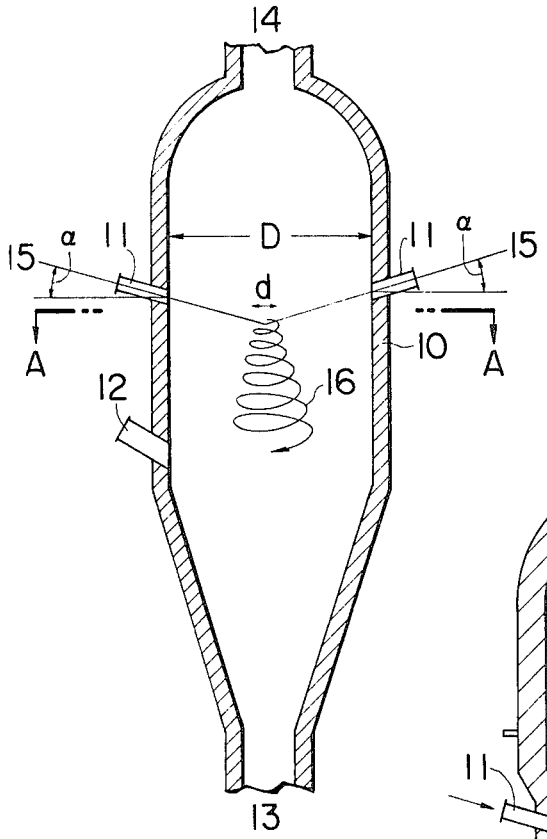
FIG. 1 is a sectional elevation showing a heat treatment furnace according to the invention in which the material to be heat-treated forms a stationary bed.
Figure 2:
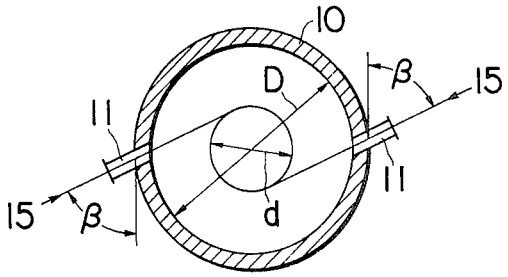
FIG. 2 is a sectional view taken along line A—A in FIG. 1.

Referring to FIGS. 1 and 2, a plurality of nozzles 11 penetrate into the upper portion of an upright cylindrical furnace 10 in such a manner that the axis of each nozzle forms an angle $\alpha$ with a line tangent to the horizontal section of the furnace, and an angle $\alpha$ with a plane perpendicular to the vertical axis of the furnace. The furnace further comprises an inclined inlet 12 for supplying material to be treated, an outlet 13 for solidified material after treatment, and an exhaust port 14. The outlet 13 is not necessary when no solid material remains after treatment.

The material to be treated forms a stationary bed, although the furnace can also be used where the material forms a movable or a fluid bed if the positions of the inlet 12 and the outlet 13 are suitably changed. In the case of a fluid bed, a primary gas ejection port (not shown) may be provided for allowing the flow of the material to be treated.

In operation, part of the material being treated is blown or splashed up out of the bed. With a stationary bed or a movable bed, light particles are splashed out of the bed when heat treatment is performed by injecting hot gas from below up through the bed. With a fluid bed, particle splashing occurs far away from the bed. Such particles are sometimes included or entrained in the material before treatment; sometimes they are created during the heat treatment itself. These splashing particles are not always uniform in shape; they may comprise fibers or powders. Thus, a variety of different shaped particles may be encountered.

If a gas stream 15 is fed through each of the nozzles 11 in a direction skewed from the vertical axis of the furnace and slightly downward, a swirling gas flow 16 is formed in the furnace. This creates a reduced pressure zone, with the lowest pressure being the central part of the swirling flow 16. The configuration of this reduced pressure zone is like a truncated cone, as shown schematically in FIG. 1.

With such a downwardly swirling flow 16, the splashing of particles out of the furnace is greatly reduced, and such particles are effectively contained by and within the swirling flow. The particles are imparted a downward force by the swirling flow, and therefore the rising speed of the flow is reduced. In addition, the swirling flow is convergent at the top, which reduces the number of escaping particles. Splashing particles having a high specific gravity are readily moved into the downward swirling flow, and carry with them the lighter particles. If the swirling flow was cylindrical in shape, as when the angle $\beta$ is 0°, it would be difficult for the lighter particles to move into the downward swirling flow. However, with the conical configuration according to the invention, the swirling and splashing particles converge while moving upwardly. As a result, they are easily caught by and entrained within the downward flow, and are returned thereby to the furnace bed. This increases the density of the particles, and enhances the physical and chemical interaction between the particles and the hot gases.

The desired conditions for forming a downwardly swirling flow in the upright cylindrical furnace 10 are as follows:

(a) The downward angle $\alpha$ of the blow nozzles 11 is $$0° < \alpha > 30°,$$

(b) The inclination angle $\beta$ formed with a horizontal line tangent to the furnace circumnference is $45° \leqq \beta \leqq 85°$, and (c) The number ($n$) of the nozzles 11 is $n \geqq 2$.

If the angle $\alpha$ is 0° or less, an upwardly swirling flow will be formed. Theoretically, the downward angle $\alpha$ could approach 90° and still form a downward flow. In order to reduce the disturbing influence of the flow on the bed, however, it would be necessary to provide a long distance between the bed and the nozzle, and this is undesirable. According to experiments, it has been found that the angle $\alpha$ should be 30° or less, and preferably between 5° and 25° for the best results.

If it is assumed that the diameter of the central part of the spiral flow at the point where the swirling flow is created, i.e. at the top of the cone, is $d$, and the diameter of a horizontal section of the furnace at the same point is D, then the relationship between these diameters can be expressed as:

$$d = D \sin (90° - \beta).$$

If the dimensional relationship for the furnace defined by $0.1 \leqq d/D \leqq 0.7$, which will be described later, is taken into account, then a limitation whereby $45° \leqq \beta \leqq 85°$ is necessarily obtained. According to experiments it has been found that a range defined by $60° \leqq \beta \leqq 82°$ is most suitable.

With only one nozzle, it is very difficult to form a stable swirling flow. Accordingly, the number of nozzles must be at least two. The optimum number of nozzles depends on the configuration of the furnace and the characteristics of the material to be treated.

With respect to the vortex of the swirling flow, as the diameter of the central part thereof at the generating point decreases, the area affected by the downward force component of the flow increases, as does the influence of the flow on the gas in the central part of the furnace. If the angle $\beta$ is increased too much to lessen the central part of the vortex, however, the gas outlet streams from the plurality of nozzles begin to interfere with each other. Therefore, no smooth swirling flow is generated, and even if it is, it becomes turbulent due to the updraft from the bed. According to experiments, the ratio of the diameters $d/D$ should be greater than 0.1 for the formation of a stable vortex, and the upper limit of the ratio $d/D$ should be 0.7 or less so that the downward force component of the swirling flow is applied to more than half of the cross-sectional area of the furnace. If the ratio is greater than 0.7, the downward force component is insufficient, and splashed particles are more likely to escape from the furnace.

The nozzles 11 are disposed in the upper part of the furnace wall, and the walls must have certain lengths both above and below the nozzles. In other words, a clean gas exits through the exhaust port 14, and if the exhaust port opening is small, a vortex flow is created at its entrance. A sufficient space must thus be provided above the nozzles so that such vortex flow does not affect the swirling flow. On the other hand, a sufficient distance is needed below the nozzles so that the swirling flow does not unduly disturb the bed. In practice, the nozzles are often provided at positions above the vertical center of the furnace wall. The positions of the nozzles cannot be rigidly specified, however, because sometimes the nozzles are arranged in two or more rows.

The flow rate of the gas introduced into the furnace through the nozzles depends, inter alia, on the dimensions of the furnace. If the flow rate is too small a stable swirling flow will not be produced, and the bed will be adversely affected. Therefore, the flow rate must have a suitable value, preferably in the range of 10 m/sec to 100 m/sec.

Figure 3:
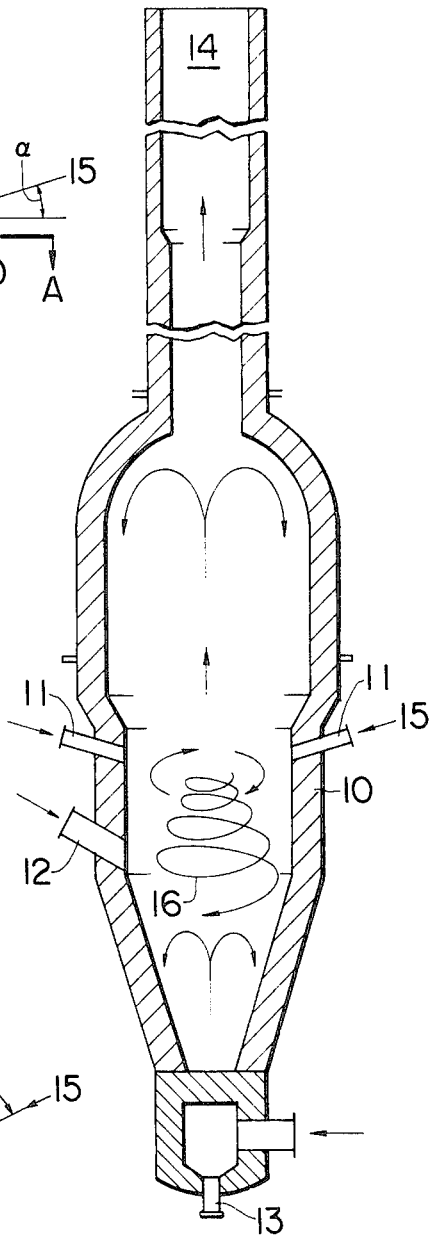
FIG. 3 is a sectional elevation showing a heat treatment furnace according to the invention in which the material to be heat-treated forms a fluid bed.

The structure of the furnace shown in FIG. 3 is fundamentally similar to that of FIG. 1. The diameter of the furnace above the nozzles is increased, however, and both portions are smoothly joined by a gently inclined arcuate ramp portion to produce the flow paths shown by the arrows. As a result, some splashing particles which pass through the upper portion of the swirling flow are swept down again, and their escape through the exhaust port 14 is more effectively prevented. The embodiment of FIG. 3 is designed to function with a fluid bed. Such a furnace has an increased high temperature volume, which leads to a more complete heat treatment, and the heat transfer area is relatively large which leads to a more efficient heat recovery.

Figure 4:
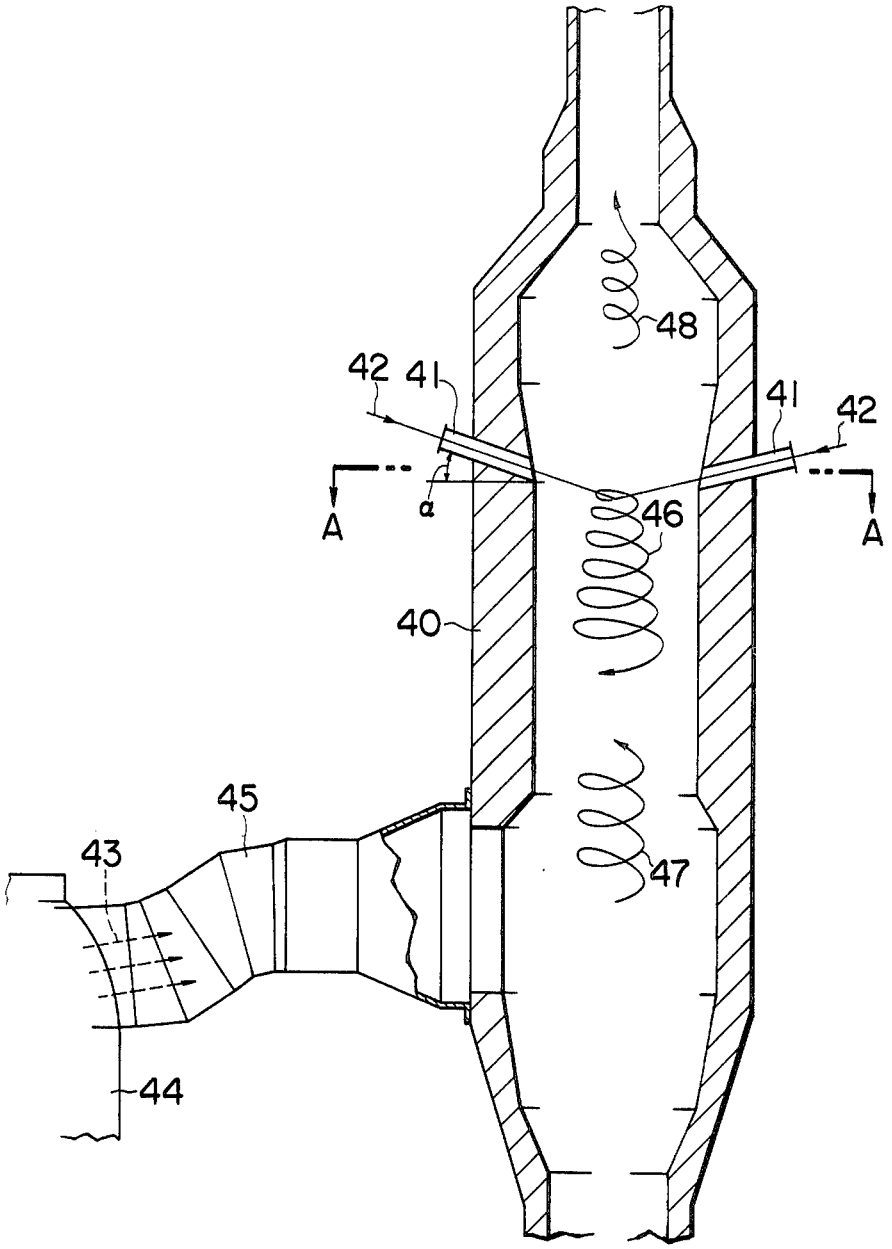
FIG. 4 is a sectional elevation illustrating a heat treatment furnace for imcomplete combustion gases.
Figure 5A:
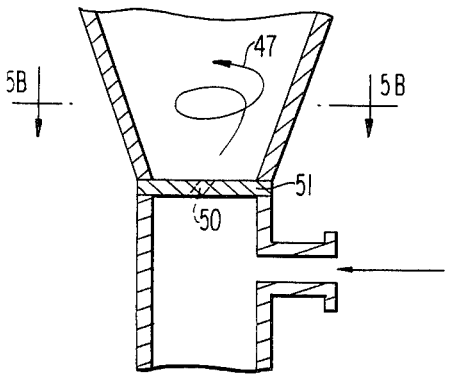
FIGS. 5A and 5B show vertical and horizontal sectional views, respectively, of a first twisted grid arrangement for imparting an upward swirl to incoming gases.
Figure 5B:
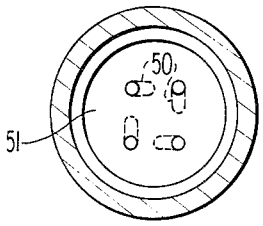
Figure 6A:
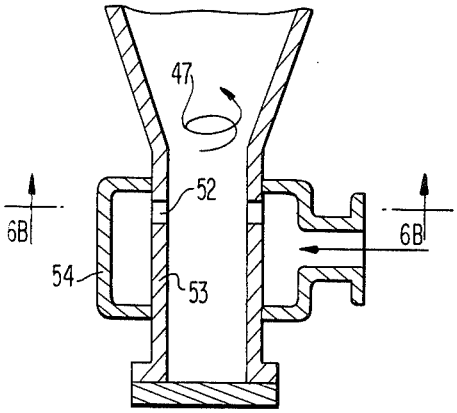
FIGS. 6A and 6B show vertical and horizontal sectional views, respectively, of a second twisted grid arrangement for imparting such an upward swirl.
Figure 6B:
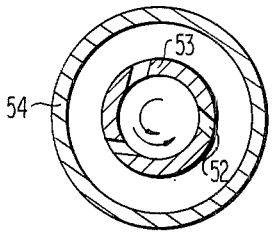

FIG. 4 shows an embodiment of the invention particularly designed for the heat treatment of incompletely combusted gases. This embodiment is similar to that shown in FIG. 1, and comprises a plurality of nozzles 41 in the upper portion of an upright furnace cylinder 40, each nozzle being introduced into the cylinder wall such that its axis forms an angle $\beta$ with a horizontal line tangent to the circumference of the cylinder and lies at a downward angle $\alpha$. The nozzles 41 are adapted to admit a flow of hot gas, usually heated air, at a temperature of at least 500° C, and preferably 600° or higher, into the furnace cylinder 40. Incompletely combusted gases generated in the furnace 44 are introduced through a duct 45. The duct 45 is connected to the furnace cylinder 40 such that the introduced gas flows upward in a swirling manner similar to the downward swirling flow introduced through the nozzles 41. Alternatively, the inlet duct 45 may be axially positioned beneath the furnace cylinder 40, and a stationary twisted grid or a rotary fan may be provided to swirl the gas flow upwardly.

Two such twisted grid arrangements are shown by way of example in FIGS. 5A, 5B and 6A, 6B, the former comprising angled apertures 50 in a diffuser plate 51, and the latter comprising angled apertures 52 in the lower side wall portion 53 of the furnace enclosed within a manifold 54.

In operation, a conical, downwardly swirling flow 46 is formed by the hot air 42 introduced through the nozzles 41. The unburned inlet gas flow 47 rises up through the central part of the swirling flow, that is, through the space therein where the pressure is reduced. As the swirling direction of the inlet gas 47 is the same as that of the downwardly swirling flow 46, the swirling operation is enhanced or accelerated. As a result, solid particles such as ash contained in the gas flow 47 are thrown out by centrifugal force as the particles rise within the furnace cylinder.

When the centrifugal force is low and the swirling flow therefore has more of a cylindrical shape, it is difficult to throw out the solid particles. Even light solid particles such as soot are trapped in the mountain-like configuration of swirling gasses. Thus, if the downward flow of swirling air is sufficiently hot in the vicinity of the nozzles, combustion occurs at the interface between the upward and downward gas flows. This is called a "flame curtain". Since the combustion occurs collectively in just this limited region, the soot is effectively burned. If non-combustible particles such as ash are included in the upwardly swirling flow, they are shifted over to the downwardly swirling flow and separated by being moved down along the cylinder wall according to the cyclone effect. Therefore, very few dust particles remain in the exhaust gas discharged from the apparatus.

The invention is not limited just to heat treatment, but can also be applied to the recovery of non-organic material by burning organic material. As compared with conventional furnaces, the heat treatment conditions are more readily controlled, and miniaturization is more easily implemented. In addition, the swirling flow concept enables the furnace to adjust more readily to different heat treatment conditions, and to adapt to the treatment of a wide range of materials. The furnace of the invention has performed well as a combustion furnace, a cracking furnace, a carbon activation furnace, and a recovery furnace.

The term "heat treatment" is used instead of the term "combustion", since the invention has been successfully used in non-flamable applications. The potential uses include the combustion of soot, carbon dust, dirt materials, molding sand, the treatment of non-combustible materials such as asbestos, the thermal cracking of ammonium sulfate, hydrogen sulfate, alkali metal salts, dithionic acid, and, imidodisulfonate, and the burning of catalysts.

Table 1 lists the data resulting from the heat-treatment of various materials according to the method and apparatus of the invention. As indicated in Example 1, if a waste material including asbestos is subjected to heat treatment at a temperature of 700° C to 1500° C, the asbestos fluff can be recovered and used again. Asbestos used in brake linings and gaskets often contains oils or resins, and even if the asbestos itself is initially pure it becomes contaminated by the cutting or grinding oil used. Such contaminated asbestos is ill-smelling and nonuniform in quality, and its recovery and reuse has never before been practical. Asbestos recovered according to the invention, however, is fresh smelling and can be used again for brake linings, packings, heat-resisting materials, heat insulators, etc. In addition, the fibers of the recovered asbestos are relatively short and heavy, and therefore are not easily blown away like "feather dust". Accordingly, the use of such recovered asbestos improves the working environment.

Even if substances other than asbestos are contained in the waste material, it scarcely causes trouble. Since organic material is burned during the heat treatment, it is unnecessary to remove it except when its recovery is desired. Most non-organic materials remain in the burned asbestos. Metals, for example, may sometimes melt during the heat treatment and solidify the recovered asbestos. In this case, it is desirable to eliminate the non-organic materials by some advance physical or chemical treatment.

The heat treatment temperature of waste material containing asbestos should be from 700° to 1500° C. With a temperature less than 700° C, the organic material may not be completely burned and the recovered asbestos may still be ill-smelling. On the other hand, at a temperature higher than 1500° C, the asbestos fibers will melt and stick together.

Using the apparatus shown in FIG. 4, when polyethylene was burned in the furnace 44 with no high temperature gas introduced through the nozzles 41, the quantity of soot dust in the exhaust stream 48 was 2 g/Nm$^3$. When air at room temperature was introduced through the nozzles, the quantity of soot dust dropped to 0.03 g/Nm$^3$; when the air temperature was raised to 800° C the quantity of soot dust was only 0.003 g/Nm³.

TABLE 1

| Example | 1 | 2 | 3 | 4 |
|---|---|---|---|---|
| Material treated | Phenol resin impregnated asbestos powder | Foamed poly-stylene | Poly-ethylene film waste | Phenol resin impregnated glass fiber cloth |
| Treatment furnace | FIG. 1 (fluid bed) | FIG. 3 | FIG. 3 | FIG. 1 (fluid bed) |
| Treatment system | Continuous | Continu-ous | Continuous | Batchwise treatment |
| Treatment quantity (Kg/Hr) | 10 | 20 | 20 | 5 |
| Treatment hours | — | — | — | 8 days |
| Swirling flow generating conditions | | | | |
| α (°) | 20 | 10 | 10 | 10 |
| β (°) | 70 | 80 | 80 | 80 |
| n | 4 | 4 | 4 | 4 |
| d/D | 0.34 | 0.17 | 0.17 | 0.17 |
| v m/sec | 62 | 28 | 28 | 20 |
| Nozzle blowing temp. (° C) | 1100 | room temp. | room temp. | 300-600 |
| Treatment temperature in the space formed between the swirling flow and the bed | 1100 | 1200 | 1200 | 300-600 |
| Rising air quantity | 0.2 m/sec. | 10 m/sec. | 10 m/sec. | 10 m/ sec. |
| Rising air temp. (° C) | room temperature | room temp. | room temp. | 300-600 |
| Discharged solid | asbestos powder | None | None | Glass fiber |

(Note 1)
FIG. 1 relates to a fixed bed, but the example is of a fluid bed in which air at room temperature or heated is blown in from below. The rising air quantity is the quantity of air flowing in through the inlet at the lower part of the device. The rising air temperature is the temperature at such inlet.
(Note 2)
Both the rising air temperature and the nozzle blowing temperature are room temperature. Examples 2, 3 and 5 use auxiliary burners for start-up.
(Note 3)
The inside diameter of the furnace is 480 mm.

| Example | 5 | 6 | 7 |
|---|---|---|---|
| Material treated | Carbon dust dried by dryer (carbon 98%; ash, metal 2% | $KHSO_4$(Powder) | Molding sand (Phenol resin about 1% by weight) |
| Treatment furnace | FIG. 3 | FIG. 3 | FIG. 3 |
| Treatment system | Continuous | Continuous | Batchwise |
| Treatment quantity (Kg/Hr) | 20 | 30 | 120 |
| Treatment hours | — | — | 15 min. |
| Swirling flow generating conditions | | | |
| α (°) | 20 | 10 | 10 |
| β (°) | 70 | 80 | 70 |
| n | 4 | 4 | 4 |
| d/D | 0.34 | 0.17 | 0.34 |
| v m/sec. | 28 | 62 | 62 |
| Nozzle blowing temp. (° C) | Room temperature | 800 | 900 |
| Treatment temperature of the space formed by the swirling flow and the bed (° C) | 1000 - 1200 | 600 | 800 |
| Rising air quantity | 0.2 m/sec. | 10 m/sec. | 1 m/sec. |
| Rising air temperature (° C) | Room temperature | 600 | 800 |
| Discharged solid | Ash, metal | $K_2SO_4$ | Recovered sand |

What is claimed is:

1. An apparatus for the heat treatment of a bed of material including a vertically oriented, generally cylindrical furnace having an inlet for introducing the bed-forming material and an exhaust gas outlet at the top of the furnace, comprising:

a plurality of gas inlet nozzles in the furnace above the bed, said nozzles being oriented at a downward angle α between the axis of each nozzle and a horizontal sectional plane through the furnace defined by $0° < \alpha \leqq 30°$, and at a skew angle β between the axis of each nozzle and a horizontal line tangent to the furnace circumference at the point where the nozzle axis intersects the furnace wall defined by $45° \leqq \beta \leqq 85°$, whereby gas streams introduced through said nozzles collectively produce a downwardly swirling flow having a truncated conical configuration to thereby confine and contain particles of the material splashed or blown up out of the bed, the inside diameter of the upper portion of the furnace, above the nozzles, being greater than that of the lower portion of the furnace containing the nozzles, and said upper and lower portions being connected by an inclined arcuate section.

2. An apparatus as claimed in claim 1, wherein said nozzles introduce air at a temperature above 500° C.

3. An apparatus as claimed in claim 1, wherein the angle α is defined by $5° \leqq \alpha \leqq 25°$.

4. An apparatus as claimed in claim 1, wherein the angle β is defined by $60° \leqq \beta \leqq 82°$.

5. An apparatus for the heat treatment of a bed of material including a vertically oriented, generally cylindrical furnace having an inlet for introducing the bed-forming material and an exhaust gas outlet at the top of the furnace, comprising:

a plurality of gas inlet nozzles in the furnace above the bed, said nozzles being oriented at a downward angle $\alpha$ between the axis of each nozzle and a horizontal sectional plane through the furnace defined by $0° < \alpha \leqq 30°$, and at a skew angle $\beta$ between the axis of each nozzles and a horizontal line tangent to the furnace circumference at the point where the nozzle axis intersects the furnace wall defined by $45° \leqq \beta \leqq 85°$, whereby gas streams introduced through said nozzles collectively produce a downwardly swirling flow having a truncated conical configuration to thereby confine and contain particles of the material splashed or blown up out of the bed, said furnace comprising an upright cylindrical section and a conical section extending below said upright cylindrical section, the inlet for supplying the material to be heat-treated being disposed on a side wall of said upright cylindrical section, an outlet for taking out solid material being provided at the lower center of said conical section, and a nozzle for ejecting a primary gas at a high temperature being provided on a side wall of said conical section, whereby the supplied material forms a fluid bed and is heat-treated by jet flow.

6. An apparatus for the heat treatment of a bed of material including a vertically oriented, generally cylindrical furnace having an inlet for introducing the bed-forming material and an exhaust gas outlet at the top of the furnace, comprising:

a plurality of gas inlet nozzles in the furnace above the bed, said nozzles being oriented at a downward angle $\alpha$ between the axis of each nozzle and a horizontal sectional plane through the furnace defined by $0° < \alpha \leqq 30°$, and at a skew angle $\beta$ between the axis of each nozzle and a horizontal line tangent to the furnace circumference at the point where the nozzle axis intersects the furnace wall defined by $45° \leqq \beta \leqq 85°$, whereby gas streams introduced through said nozzles collectively produce a downwardly swirling flow having a truncated conical configuration to thereby confine and contain particles of the material splashed or blown up out of the bed, said furnace comprising an upright cylindrical section and a conical section extending below said upright cylindrical section,, the inlet for supplying gas containing the material to be heat-treated being disposed on the lower side wall of said upright cylindrical section, and the furnace being so designed that said gas flows in the furnace apart from the central axis of said cylindrical section, to thereby swirl upwardly toward said downwardly swirling flow.

7. An apparatus for the heat treatment of a bed of material including a vertically oriented, generally cylindrical furnace having an inlet for introducing the bed-forming material and an exhaust gas outlet at the top of the furnace, comprising:

a plurality of gas inlet nozzles in the furnace above the bed, said nozzles being oriented at a downward angle $\alpha$ between the axis of each nozzle and a horizontal sectional plane through the furnace defined by $0° < \alpha \leqq 30°$, and at a skew angle $\beta$ between the axis of each nozzle and a horizontal line tangent to the furnace circumference at the point where the nozzle axis intersects the furnace wall defined by $45° \leqq \beta \leqq 85°$, whereby gas streams introduced through said nozzles collectively produce a downwardly swirling flow having a truncated conical configuration to thereby confine and contain particles of the material splashed or blown up out of the bed, said furnace comprising an upright cylindrical section and a conical section extending below said upright cylindrical section, the inlet for supplying gas containing the material to be heat-treated being disposed at the lower part of said upright cylindrical section, and a fixed twisted grid being provided in the vicinity of said gas supplying inlet, to thereby generate an upwardly swirling flow.

* * * * *